United States Patent [19]

Troxell, Jr.

[11] Patent Number: 4,601,232

[45] Date of Patent: Jul. 22, 1986

[54] ROD LOCKING DEVICE

[75] Inventor: John N. Troxell, Jr., Houston, Tex.

[73] Assignee: Cameron Iron Works, Inc., Houston, Tex.

[21] Appl. No.: 707,200

[22] Filed: Mar. 1, 1985

[51] Int. Cl.[4] ..... F15B 15/26

[52] U.S. Cl. ..... 92/24; 188/67; 251/1.3; 92/27

[58] Field of Search ..... 92/27, 28, 24, 123, 92/126, 23; 251/1 A; 188/67; 74/531

[56] References Cited

U.S. PATENT DOCUMENTS

| | | | |
|---|---|---|---|
| 2,845,902 | 8/1958 | Anderson | 91/4 S |
| 3,208,357 | 9/1965 | Allen et al. | 251/1 A |
| 3,470,793 | 10/1969 | Hanehen | 92/28 |
| 3,941,141 | 3/1976 | Robert | 92/24 |
| 4,052,995 | 10/1977 | Ellison | 92/27 |
| 4,076,208 | 2/1978 | Olson | 92/24 |
| 4,290,577 | 9/1981 | Olson | 92/24 |
| 4,305,565 | 12/1981 | Abbe | 92/27 |

*Primary Examiner*—Robert E. Garrett
*Assistant Examiner*—Mark A. Williamson
*Attorney, Agent, or Firm*—Vinson & Elkins

[57] ABSTRACT

There is disclosed an improved device for locking reciprocating piston type fluid actuators in a desired position. The device includes a body, a piston having a lost motion connection to the body, a locking piston being movable with respect to the piston, an actuating cone supported on the piston, split locking cone elements surrounding the actuating cone and having a connection to the body, a split locking ring interconnected to the lock piston and surrounding the split locking cone elements, a housing containing the elements, a movable rod extending into the housing for engagement by said body, and means to supply fluid under pressure to the locking assembly, the application of pressure initially moving the locking assembly and when the rod is in its desired position for locking and further movement provides wedging locking of the structure in its housing bore and locks said rod in position.

7 Claims, 5 Drawing Figures

ROD LOCKING DEVICE

BACKGROUND

This invention relates to an improved device for locking reciprocating piston type fluid actuators in a desired position. A particular application for such improved actuator locking device is the piston actuator connected to the rams of a ram type oilfield blowout preventer.

When oilfield ram type blowout preventers are in use, it occasionally becomes necessary to lock the rams in the closed position. The prior art of blowout preventers has numerous devices for locking a ram in its closed position. Such devices range from a simple mechanical screw which is threaded through the bonnet to engage the outer end of the ram connecting rod or piston to prevent its movement in the outward direction to complicated devices such as shown in U.S. Pat. No. 4,305,565 wherein a locking cone responds to fluid pressure during the movement of the ram to move the locking wedges into engagement with the tapered inner surfaces of the housing.

Another ram lock structure is shown in U.S. Pat. No. 3,941,141 which includes slip-like structures operated on a dovetail for movement of the slips to engage the threads on the tail rod.

Other prior art patents, such as U.S. Pat. Nos. 4,052,995 and 4,076,208 and 4,290,577 disclose ram locks wherein a lock nut is stopped from rotating by a clutch mechanism which has ratchet teeth.

U.S. Pat. No. 2,845,902 discloses a self-locking fluid linear actuator which utilizes cones in a tapered section for locking following movement but is released responsive to hydraulic pressure.

SUMMARY

The improved device of the present invention provides a lock suitable as a lock for the rod of a hydraulic cylinder or as a blowout preventer ram lock.

The improved blowout preventer ram lock device includes a cylinder in which a body is positioned for movement relative to the tail rod of the ram actuator, a piston, a lost motion connection between the piston and the body, a lock piston, a split locking ring interconnected to the lock piston, a split locking cone connected to the body, and an actuating cone coacting with the split locking cone and the split locking ring, and means for supplying pressure to said piston and said lock piston to cause said body to engage the tail rod of the ram in the position in which the ram is desired to be locked.

An object of the present invention is to provide an improved shaft locking device which will lock the rod of a hydraulic cylinder in a desired position simply and quickly.

Another object is to provide an improved ram lock for a ram type blowout preventer which is responsive to fluid pressure and is not subject to difficulties and complications of prior ram locks.

A further object is to provide an improved ram lock for a blowout preventer wherein the locking position may vary to compensate for ram packer wear.

A still further object is to provide an improved ram lock for a blowout preventer in which problems of impacts between the lock and ram tail rod are avoided.

BRIEF DESCRIPTION OF THE DRAWINGS

These and other objects and advantages of the present invention are hereinafter set forth and explained with reference to the drawings wherein.

DESCRIPTION OF THE PREFERRED EMBODIMENTS

Figure 1:
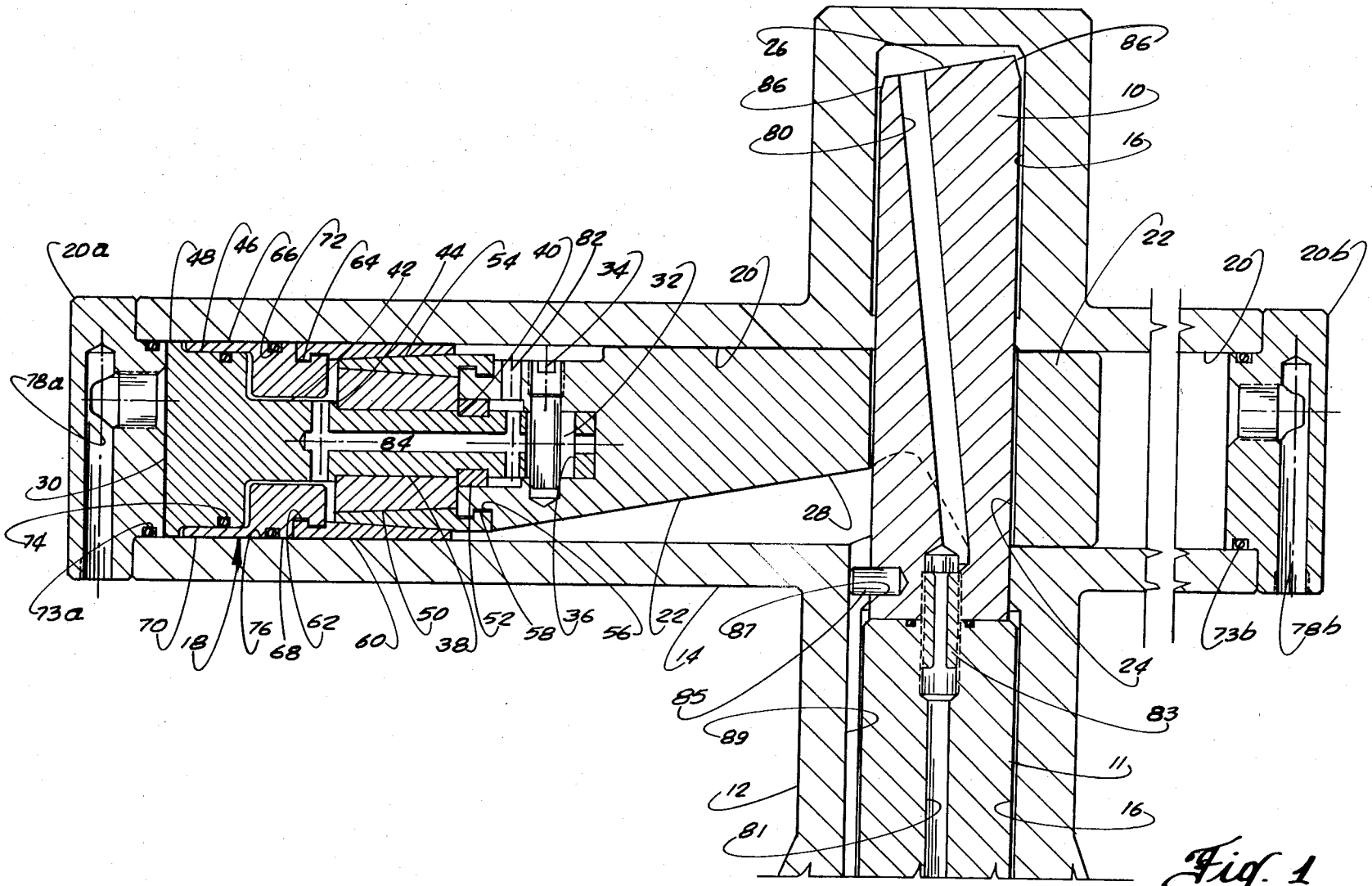
FIG. 1 is a sectional view of the improved ram lock of the present invention in its unlocked position.

In FIG. 1 tail rod extension 10 is attached to ram actuator tail rod 11 of a ram type blowout preventer (not shown) and extends through housing 12 which is in the form of a tubular cross 14 with the tail rod extension 10 and actuator tail rod 11 extending through housing bore 16 across transverse bore 20 and through lock assembly 18 which is positioned in housing transverse bore 20. The outer end of bore 16 is closed as shown and end caps **20*a* and 20*b* are secured to housing 12 to close the ends of transverse bore 20**.

Figure 2:
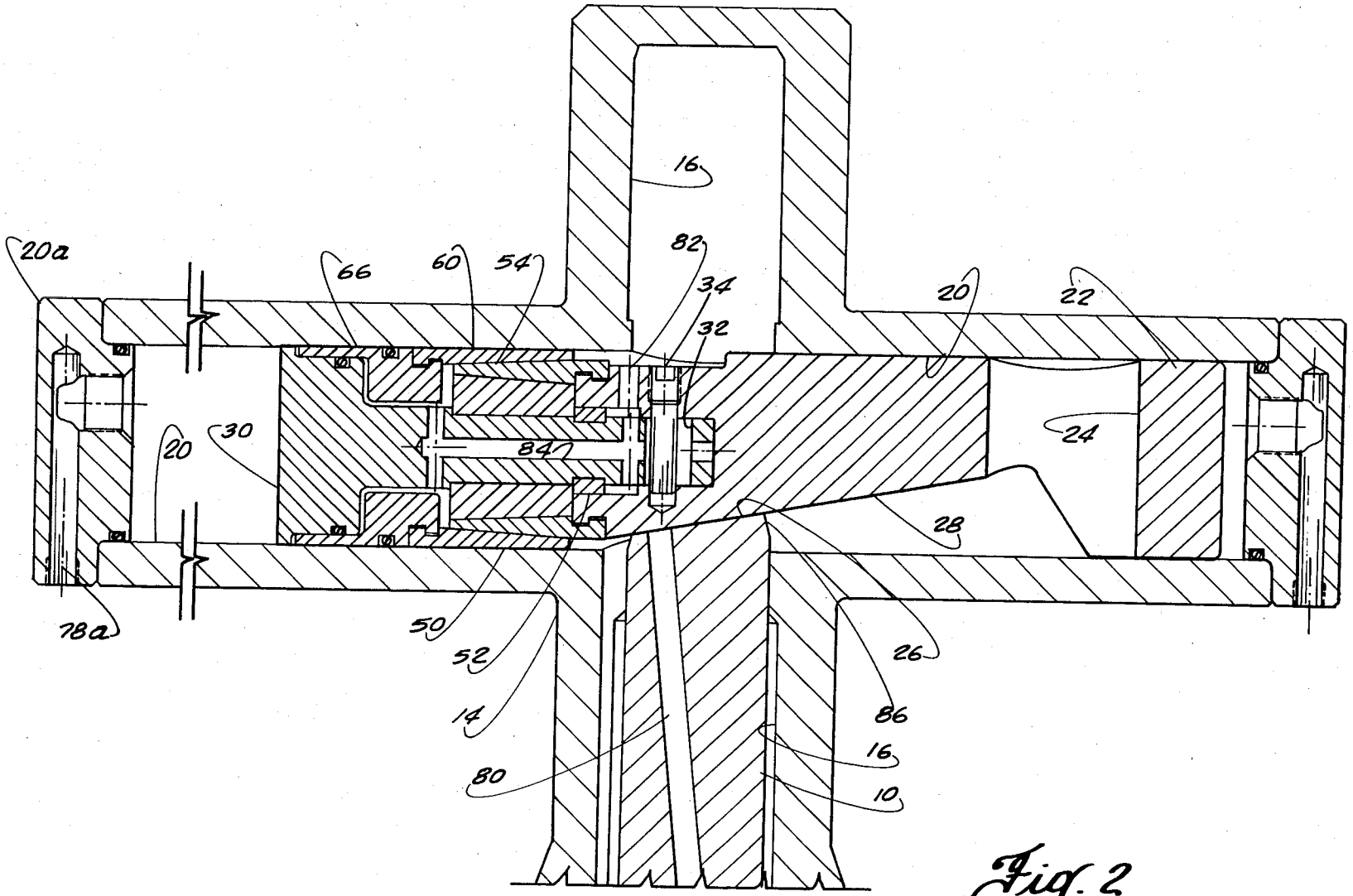
FIG. 2 is another similar sectional view of the improved ram lock shown in its locked position.

Lock assembly 18 includes body 22 extending along bore 20 and having a bore 24 therein which receives tail rod extension 10 as shown. In its unlocked position as shown in FIG. 1, tail rod extension 10 is free to reciprocate with the movement of the ram actuator to which it is connected. When the ram actuator moves inwardly until the two rams (not shown) engage one another in the closed position, tapered end 26 of tail rod extension 10 is positioned as shown in FIG. 2 so that it may be engaged by tapered surface 28 on body 22 to lock the rams in the closed position. Moving means for reciprocating body 22 in transverse bore 20 is provided. Such moving means includes operating piston 30 which is secured to body 22 through lost motion connection 32. Connection 32 includes pin 34 secured in body 22 and extending through longitudinal slot 36 in piston 30. Piston 30 has a stepped body with projection 38 having the smallest diameter and external groove 40 extending around its exterior near slot 36, intermediate section 42 with shoulder 44 between projection 38 and section 42, end section 46 and ends in flange 48. Actuating cone 50 is positioned around projection 38 against shoulder 44 and is secured in such position by split thrust ring 52 positioned in groove 40. Split locking cone elements 54 surround actuating cone 50 and include interengaging ends 56 which engage in groove 58 around the exterior of body 22. Split locking ring 60 surrounds elements 54 and includes interengaging ends 62 which engage within groove 64 on the exterior of locking piston 66. Locking piston 66 includes main body portion 68 and tubular extension 70 surrounding the exterior of end section 46 of operating piston 30. Sealing means, such as O rings 72 and 74, are provided to seal between the exterior of end section 46 and the interior of tubular extension 70 and between the exterior of body portion 68 and the interior surface 76 of transverse bore 20.

Communication is provided to opposite sides of operating piston 30 through port 78*a* in the end cap 20*a* and through port 78*b* in end cap 20*b*. End caps 20*a* and 20*b* are secured to housing 12 by suitable means (not shown) such as capscrews and sealed to bore 20 by sealing means, such as O rings 73*a* and 73*b*. Bore 80 in tail rod extension 10 communicates through ported stud 83 and bore 81 of actuator tail rod 11 to the side of the ram actuator piston which causes retraction of the ram. Pressure from port 78*a* acts on the locking side of operating piston 30. Pressure from port 78*b* acts on the unlocking side of piston 30 and on locking piston 66 by going through port 82 in body 22 and passage 84 through projection 38 of piston 30 into the space between locking piston 66 and locking cone elements 54 and actuating cone 50. Anti-rotation pin 85 is inserted in hole 87 of tail rod extension 10 and rides in groove 89 of housing 12 to prevent rotation of extension 10 and to thereby ensure that surface 26 of tail rod extension 10 remains essentially parallel to surface 28 of body 22. In the drawings, the legs of tubular cross 14 are illustrated as being at right angles to each other but it is contemplated that the axis of transverse bore 20 could be tilted so that surface 28 of body 22 is perpendicular to the centerline of bore 16 and mates with and uniformly engages an untapered flat outer end of tail rod extension 10. Also, if tubular cross 14 is tilted so that surface 28 is perpendicular to the centerline of bore 16, a modified longer actuator tail rod 11 could be used instead of tail rod extension 10.

Whenever the blowout preventer ram is moved to its closed position, tail rod extension 10 moves to the position shown in FIG. 2. Pressure is then introduced through port 78*a* to piston 30 to cause lock assembly 18 to move to the position shown in FIG. 2 in which tapered surface 28 of body 22 engages tapered surface 26 on the outer end of tail rod extension 10. Upon the initial application of pressure, locking assembly 18 moves to the right until it is in its locking position and thereafter the pressure is exerted on locking piston 66 to cause split locking ring 60 to be wedged into locking engagement between surface 76 of bore 20 and the exterior of split locking cone elements 54.

In operation, the improved apparatus of the present invention as described above and shown in the drawings functions from a position in which it is unset as shown in FIG. 1 to a position in which it is set and locked as shown in FIG. 2. In the unset position, tail rod extension 10 is in its retracted position with its outer tapered end close to the closed end of bore 16 and with lock assembly 18 in its extreme position adjacent end cap 20*a*. When the ram to which actuator tail rod 11 is connected is moved to its closed position tail rod extension 10 moves in bore 16 so that outer end 26 is positioned in the lower portion of bore 20 as shown in FIG. 2. If it is desired to lock the ram in its set position, then lock assembly 18 is actuated by introducing fluid under pressure through port 78*a* in end cap 20*a*. This pressure causes lock assembly 18 to move to the right in bore 20 because the pressure is trapped within bore 20 to the left of piston 30 and lock piston 66. When tapered surface 28 on body 22 is in tight engagement with outer tapered surface 26 of tail rod extension 10, movement of body 22 stops and subsequent movement responsive to pressure only results from the independent movement of locking piston 66 which urges split locking ring 60 into locking position between the interior of bore 20 and the exterior of split locking cone elements 54. Split locking cone elements 54 are urged against the exterior of cone 50 to prevent any axial movement of lock assembly 18 until such time as it is desired to release lock assembly 18. This set and locked position is the position shown in FIG. 2.

Blowout preventer rams utilize ram front packers (not shown) which are subject to wear after repeated closures. Due to this possible wear and routine machining tolerances, the rams do not always stop at the same position when closed. Therefore any ram locking device used must be capable of locking the rams at a position that will not be precisely known. In FIG. 2 tapered surface 28 has engaged tapared surface 26 with lock assembly 18 having moved almost its entire allowable stroke. This will occur when the ram front packers have experienced considerable wear. With new ram front packers surface 28 will engage surface 26 in close proximity to bore 24. By having surfaces 28 and 26 tapered a wide range of infinite locking positions is achieved so that wear and machining tolerances are accommodated.

Because the tapers of the components of locking assembly 18 are all self locking tapers, the tail rod extension 10 and its ram will be held in the closed position when the fluid under pressure is released from port 78*a* and the lock assembly 18. When it is desired to unlock the lock assembly 18 and move the ram into the open position fluid under pressure is introduced through port 78*b* in end cap 20*b*. This pressure is exerted on locking assembly 18 but initially only piston 30 and locking piston 66 move. The initial movement is accommodated by lost motion connection 32. This movement causes actuating cone 50 and split locking ring 60 to move to the left and thereby release split locking cone elements 54. In this movement the locking of locking assembly 18 is released and the whole assembly moves to the left. This movement is relatively rapid as soon as split locking ring 60 is released. Movement of body 22 uncovers the upper end of bore 80 in tail rod extension 10 which communicates with the side of the ram actuator piston which is used for the retraction movement of the ram and tail rod extension 10. Prior to any appreciable amount of movement of tail rod extension 10 locking assembly 18 will have moved to its unset position. The port 80 is not completely uncovered until locking assembly 18 has moved a substantial distance and gathered speed so that the lapse of time for the fluid under pressure to reach the ram actuator piston and initiate its retracting movement allows locking assembly 18 to be completely moved to unset position with bore 24 of body 22 in substantial alignment with bore 16. In this movement the release of the wedging action of actuating cone 50, split locking cone elements 54 and split locking ring 60 are seen by a slight exaggeration of the space between the components in the releasing movement of the assembly shown in FIG. 3.

In the event bore 24 in body 22 is not completely aligned with bore 16 as tail rod extension 10 commences its upward movement, the upper end of tail rod extension 10 also includes an edge taper 86 which ensures that tail rod extension 10 aligns and passes through bore 24.

Figure 3:
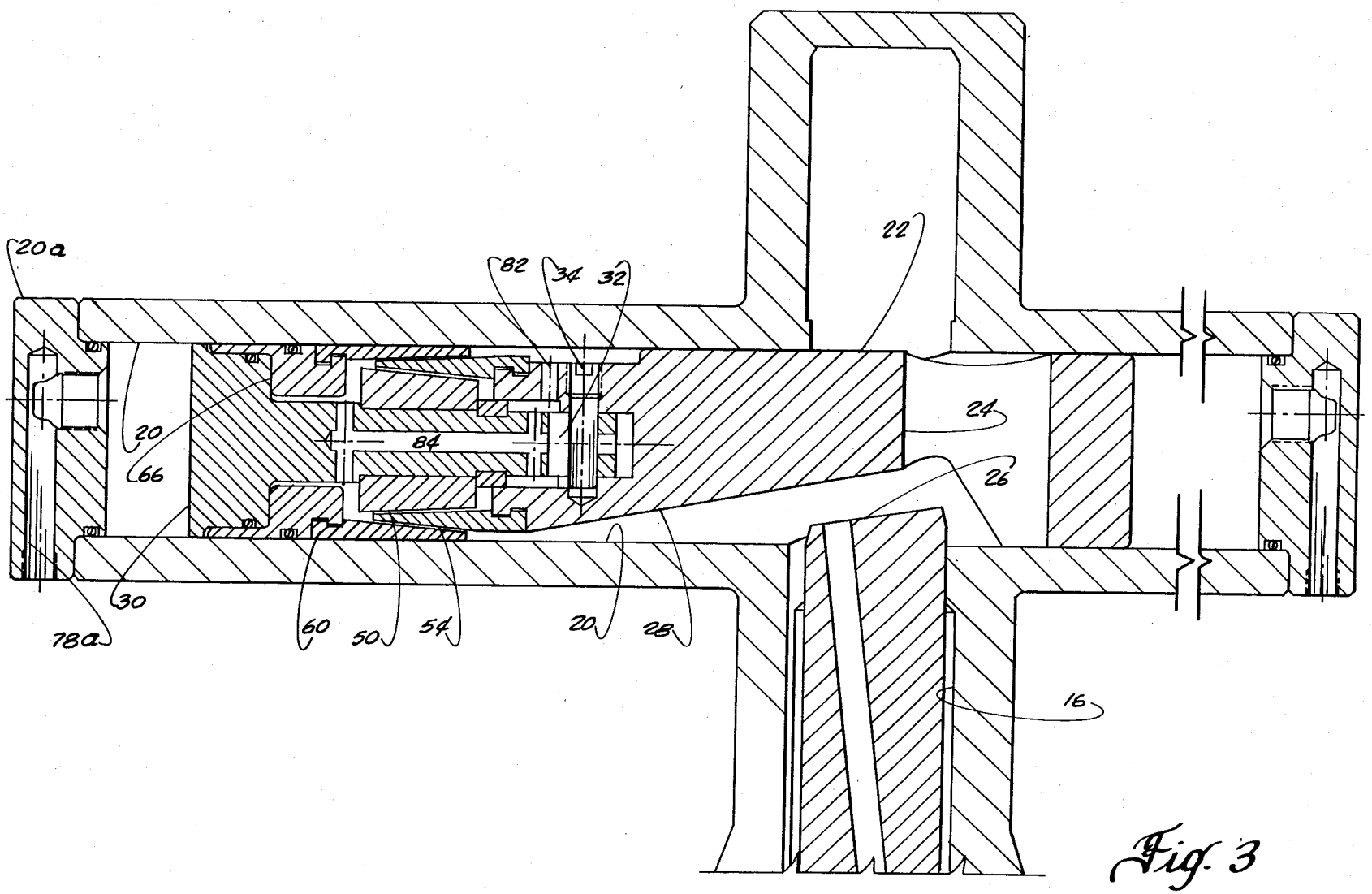
FIG. 3 is another similar sectional view of the improved ram lock being retracted.
Figure 4:
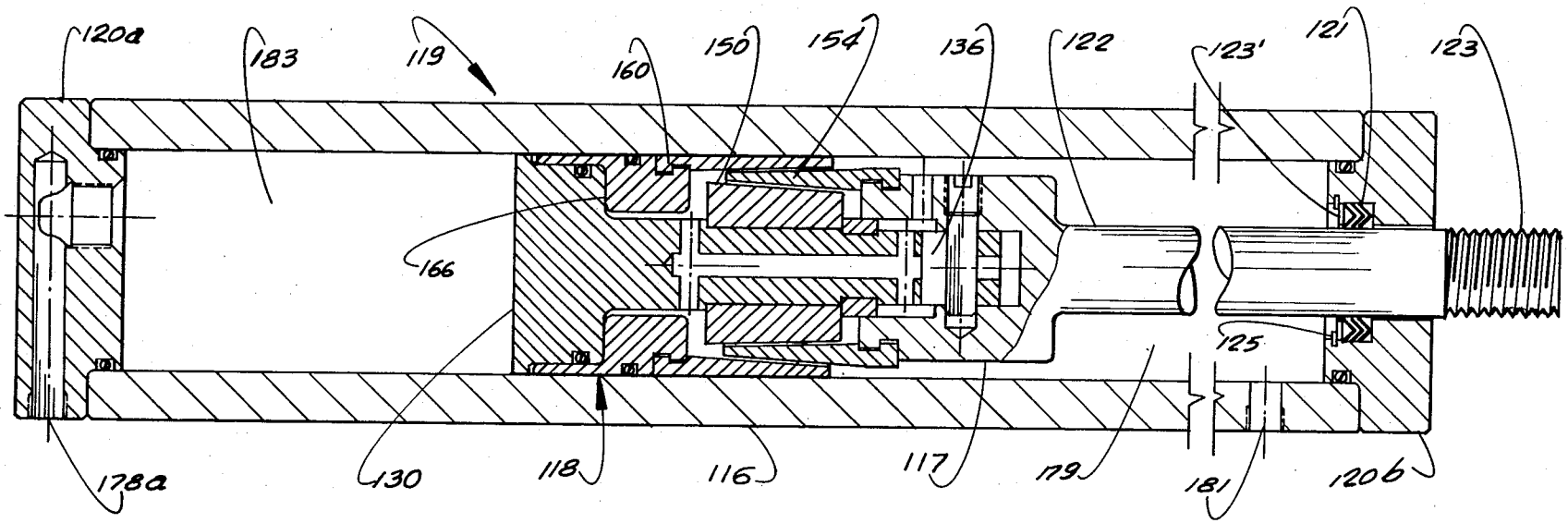
FIG. 4 is a sectional view of another embodiment of the present invention.

Another embodiment of the present invention is the improved lock 118 for hydraulic cylinder 119 as shown in FIG. 4. Lock assembly 118 includes piston 130, actuating cone 150, split locking cone elements 154, split locking ring 160 and locking piston 166 all of which function in a manner similar to their comparable parts as shown in FIGS. 1 through 3 of the preferred embodiment and described previously herein. Hydraulic cylinder 119 includes housing 116, body 117 with piston rod 122 extending therefrom. Rod 122 has threads 123 or other suitable means on its exposed end to engage a work piece (not shown). Piston rod 122 passes through end cap **120*b* and is sealingly engaged therein by packing unit 121. Packing unit 121 is secured by support ring 123' and retainer ring 125**.

A typical application for hydraulic cylinder 119 would be to raise and hold a load (not shown) attached to rod threads 123 by the introduction of high pressure fluid through port **178*a* of end cap 120*a* into chamber 183. As the load is being raised, fluid pressure is released from cavity 179 through port 181 by suitable valving means (not shown). When the load has been raised to the desired height, fluid in cavity 183 would be blocked by the suitable valving means and the parts comprising lock assembly 118 would be disposed in a locked position similar to that of lock assembly 18 in FIG. 2 of the preferred embodiment. Because the tapers of the components of lock assembly 118 are all self locking tapers, the raised load would continue to be supported by the lock assembly even though fluid pressure in cavity 183 would be released, providing that no fluid pressure is present in cavity 179 or introduced through port 181 into cavity 179**.

The load can be lowered or support removed from the load by introducing fluid pressure through port 181 into cavity 179; however, if it is desired to lower the load in a controlled manner, fluid pressure should be present in cavity 183 which can then be slowly released through port **178*a* as fluid pressure is slowly and simultaneously introduced through port 181 into cavity 179. In this manner the lock assembly 118 will be released as shown in FIG. 4 and will slowly lower the load attached to threads 123**.

Figure 5:
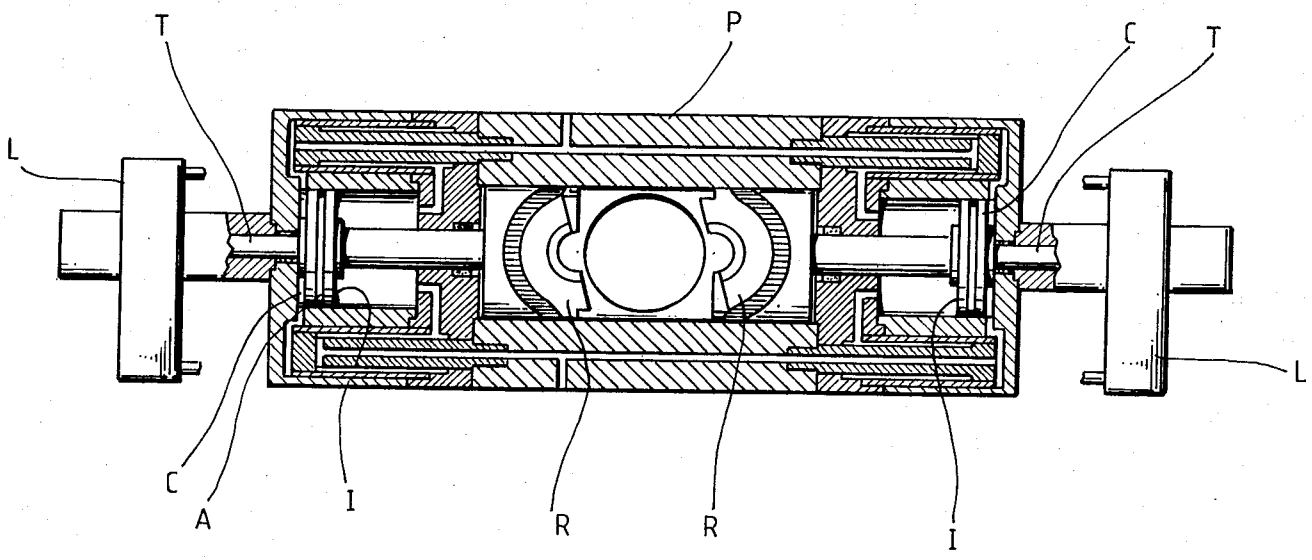
FIG. 5 is a plan view partly in section of a ram-type blowout preventer with the improved locking device of the present invention installed at each end to engage the trial rods and lock the rams in their closed or inner position.

The improved locks L of the present invention are shown installed on the outer ends of the blowout preventer P in FIG 5. Rams R are closed and retracted by the ram actuating means or pistons A and tail rods T extend through the outer ends of preventer P into the housings of locks L. The inner sides I of pistons A are considered herein to be retraction sides and the outer sides C are considered herein to be the closing sides.

What is claimed is:

1. A ram locking apparatus used on a blowout preventer having a housing, a ram, ram actuating means having a closing side and a retracted side and a tail rod having its inner end connected to the ram actuating means and its outer end engaged by said apparatus to lock said ram, said apparatus comprising a lock housing having a closed end and a hollow interior connected to the exterior of the preventer housing in which the tail rod is positioned, a body positioned within said lock housing, a primary piston, a lost motion connection between said primary piston and said body, a lock piston associated with said primary piston and movable axially with respect to said primary piston, a tapered split locking ring interconnected to said lock piston, wedging means within said split locking ring, and means for supplying fluid under pressure into said lock housing for movement of said pistons, the initial pressure on said primary piston causing movement of said body to engage the ram tail rod and subsequently moving said lock piston relative to said wedging means and to thereby wedge said split locking ring against the interior of said lock housing to lock said body therein against movement in said lock housing.

2. A ram locking apparatus according to claim 1 wherein said wedging means includes an actuating cone secured to said primary piston, and conical elements connected to said body and positioned between said actuating cone and said split locking ring, movement of said primary piston and said body toward said tail rod moving said actuating cone within said conical elements to wedge said conical elements outwardly, and subsequent movement of said lock piston moving said split lock ring into wedging engagement between said conical elements and the interior of said lock housing.

3. A ram locking apparatus according to claim 1 including a bore through said tail rod communicating with the retraction side of the ram actuating means from the outer end of said tail rod, the engagement of said body with said tail rod closing said tail rod bore whereby said body is retracted from its locking position prior to the pressure responsive retraction of the ram.

4. A ram locking apparatus used on a blowout preventer having a housing, a ram, ram actuating means having a closing side and a retracted side and a tail rod having its inner end connected to the ram actuating means and its outer end engaged by said apparatus to lock said ram, said apparatus comprising a lock housing having a closed end and a hollow interior connected to the exterior of the preventer housing in which the ram tail rod is positioned, a body positioned within said lock housing, a primary piston, a lost motion connection connecting said primary piston to said body, a lock piston associated with said piston, a split locking ring interconnected to said lock piston, a split locking cone connected to said body and positioned within said split locking ring, an actuating cone within said split locking cone, and means for supplying fluid under pressure into said lock housing for movement of said pistons, the initial pressure on said primary piston causing said body to engage the ram tail rod and subsequently moving said lock piston to wedge said split locking ring against the taper of said split locking cone and wedge against the interior of said lock housing to lock said body therein against movement.

5. A rod locking apparatus comprising a housing having a bore therethrough, .

a closure secured to each end of the housing, a body within said housing bore, a primary piston positioned within said housing bore for reciprocation therein responsive to hydraulic pressures on opposite sides thereof, said primary piston connected to said body by a lost-motion connection, a lock piston associated with and movable with respect to said primary piston, a tapered split locking ring interconnected to said lock piston, wedging means within said split locking ring, means for supplying hydraulic fluid under pressure to opposite ends of said housing, the initial pressure on said primary piston causing movement of said body and subsequently moving said lock piston relative to said wedging means to wedge said split locking ring against the interior of said housing to lock said body against movement therein, and a movable rod to be locked in position extending into said housing in position for engagement with said body to lock said rod against further movement into said housing.

6. A rod locking apparatus according to claim 5 including a tapered surface on said body, a side opening into said housing, said rod extending through said opening into said body in position for engagement by said body tapered surface with its end for locking said rod in position.

7. A rod locking apparatus according to claim 5 including said rod extending from the end of said body away from said piston and through the end closure at the end of the housing away from said piston.

* * * * *